US005146198A

United States Patent [19]

Pollard et al.

[11] Patent Number: 5,146,198

[45] Date of Patent: Sep. 8, 1992

[54] SEGMENTED CORE INDUCTOR

[75] Inventors: David D. Pollard, Fairfield Glade, Tenn.; Mark W. Bailey, Lima, Ohio

[73] Assignee: Westinghouse Electric Corp., Pittsburgh, Pa.

[21] Appl. No.: 723,040

[22] Filed: Jun. 28, 1991

[51] Int. Cl.[5] ..... H01F 27/24; H01F 27/30

[52] U.S. Cl. ..... 336/178; 336/55; 336/212; 336/218; 336/223

[58] Field of Search ..... 336/178, 165, 223, 212, 336/218, 5, 10, 12, 55, 60, 61

[56] References Cited

U.S. PATENT DOCUMENTS

| | | | |
|---|---|---|---|
| 1,117,293 | 11/1914 | Wilson | 336/178 |
| 1,727,834 | 9/1929 | Kubler | 336/178 |
| 3,212,040 | 10/1965 | Gibson | 336/178 |
| 3,426,305 | 2/1969 | Keble | 336/178 |
| 3,611,032 | 10/1971 | Skillicorn | 336/178 |
| 4,447,795 | 5/1984 | Sefko et al. | 336/178 |
| 4,531,108 | 7/1985 | Brondes | 336/178 |
| 4,763,094 | 8/1988 | Kojima | 336/178 |
| 4,902,998 | 2/1990 | Pollard | 336/223 |

FOREIGN PATENT DOCUMENTS

| | | | |
|---|---|---|---|
| 386600 | 12/1923 | Fed. Rep. of Germany | 336/178 |
| 2454393 | 5/1976 | Fed. Rep. of Germany | 336/178 |
| 55-11389 | 1/1980 | Japan | 336/178 |
| 56-88308 | 7/1981 | Japan . | |

OTHER PUBLICATIONS

Magnetics Technical Bulletin No. TWC-S5A, "Composite Cores", 1986.

McLyman, W. T., Transformer and Inductor Design Handbook, Marcel Dekker, Inc., New York and Basel, 1988.

*Primary Examiner*—Thomas J. Kozma

*Attorney, Agent, or Firm*—R. P. Lenart

[57] ABSTRACT

A multiple phase inductor includes a magnetic core having two end pieces and a plurality of legs extending between the end pieces to form flux paths which pass through the end pieces and the legs. Each leg includes a stack of "I" shaped laminations which are positioned between the end pieces to form two gaps in at least one of the flux paths. A coil is wound around each of the legs and all of the coils present substantially the same inductance to an external power circuit. By providing two gaps in each of the legs, localized heating of the turns of the coils is reduced.

4 Claims, 2 Drawing Sheets

SEGMENTED CORE INDUCTOR

BACKGROUND OF THE INVENTION

This invention relates to electrical devices and, more particularly, to multiple phase inductors.

Power inverters, converters and the like include inductors which must carry high currents in their coils. The size and weight of these inductors is dependent upon the ability to dissipate heat produced by this current flow. High current inductors have been constructed to include a single layer wound coil with the coil being exposed to some coiling media such as air or oil. To improve cooling, individual turns of the coil have been spaced apart so that coolant will reach the sides of each turn in addition to the outer edges of the turns. Even with single layer coils having spaced apart turns, these devices may represent a large percentage of the inverter or converter total weight.

A typical three phase inductor for use in an aircraft power source may include two laminated "E" shaped cores of silicon steel with three single layer coils of a rectangular conductor wound on edge around the legs of the cores. The core dimensions, number of coil turns, and the coil conductor size are all dependent upon the desired power rating. To achieve the desired inductance, there are typically three gaps in the core which are placed at the center of each leg. The size of the gap is also dependent upon rating but typically varies from 0.25 inch to 0.50 inch.

The turns of the coil which are wound over or in close proximity to the gap space in the core may be subjected to substantially higher temperatures than the other turns of the coil. In high power rated air cooled inductors, the local heating of particular coil turns can cause failure of those turns. This local heating is caused by flux fringing around the gap space in the core. The flux penetrates the coil turns and causes high eddy currents. Since the coil conductor is rectangular and presents its largest surface area to the flux path, the heating normally is worse than it would be with round or flat conductors. However, rectangular conductors are used to conserve weight and to reduce the size of the inductor.

A secondary problem faced by such inductors is an imbalance in the inductance between the center leg and the outer legs. This imbalance is typically corrected by reducing the core size (number of laminations) for the center leg.

This invention seeks to provide a segmented core inductor which is resistent to failure caused by localized heating of selected turns of the inductor coil, while at the same time providing equal inductances for each coil.

SUMMARY OF THE INVENTION

A multiple phase inductor constructed in accordance with this invention includes a magnetic core having two end pieces and a plurality of legs extending between the end pieces. The magnetic core forms a plurality of flux paths which pass through the end pieces and the legs. A coil is wound around each of the legs. Each of the legs includes a stack of "I" shaped leg laminations positioned between the end pieces to form two gaps in at least one of the flux paths.

By providing two gaps in each of the legs of the inductor core, localized heating of the coil turns is reduced and a substantially equal inductance is provided by each of the coils.

BRIEF DESCRIPTION OF THE DRAWINGS

This invention will become more readily apparent to those skilled in the art from the following description of the preferred embodiment thereof as shown in the drawings wherein.

DESCRIPTION OF THE PREFERRED EMBODIMENT

Figure 1:
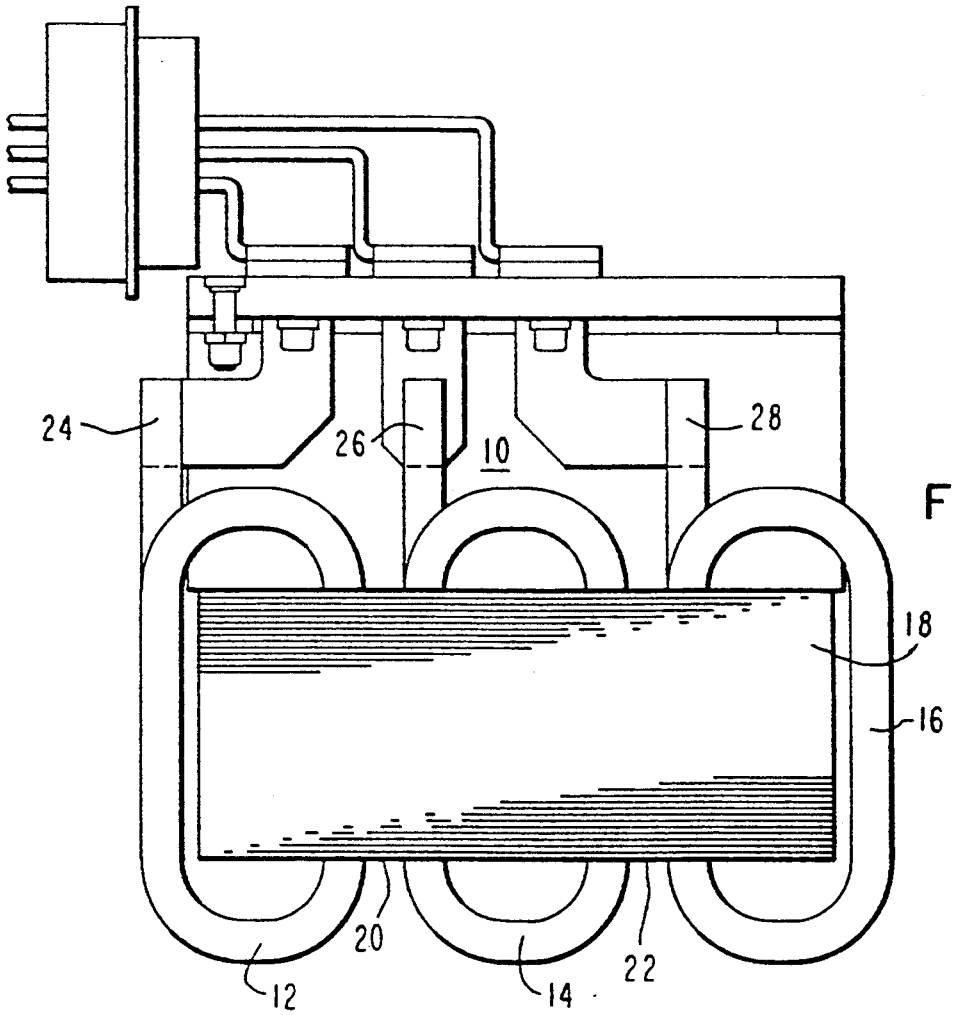
FIGS. 1 and 2 are top and end views of an inductor assembly constructed in accordance with this invention.
Figure 2:
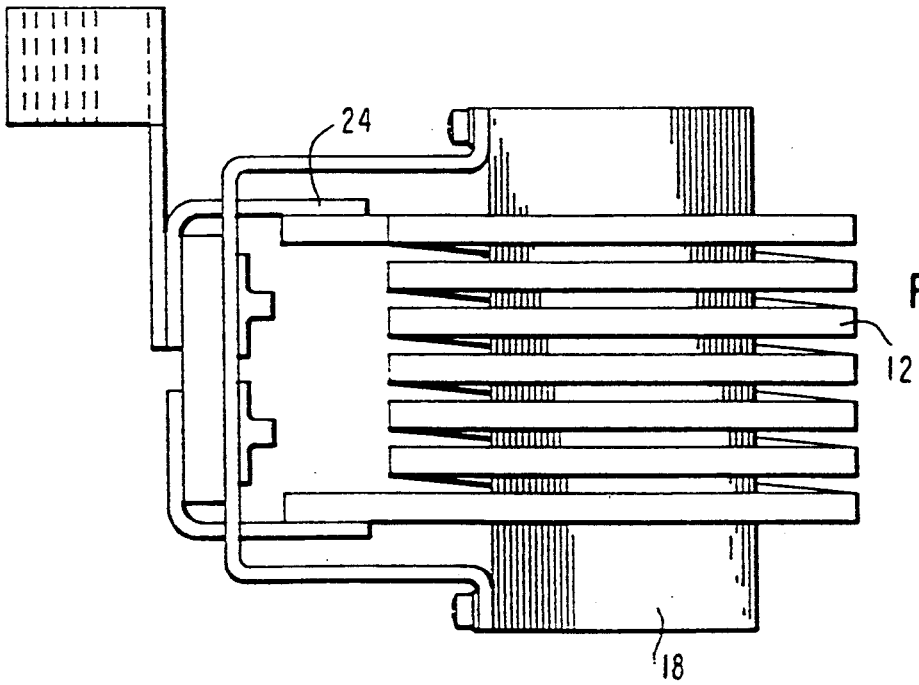

Referring to the drawings, FIGS. 1 and 2 are top and end views of an inductor assembly 10 constructed in accordance with this invention. The assembly includes three coils 12, 14 and 16 which are wound in single layers about separate legs of a laminated magnetic core 18. Portions of each of the coils pass through apertures 20 and 22 in the core. Bus bars 24, 26, and 28 provide electrical connections to the circuit of an associated power apparatus. As illustrated in FIG. 2, coil 12 includes a plurality of turns of a conductor having a rectangular cross-section. These turns are spaced apart so that cooling medium can contact the sides and outer edges of each turn.

Figure 3:
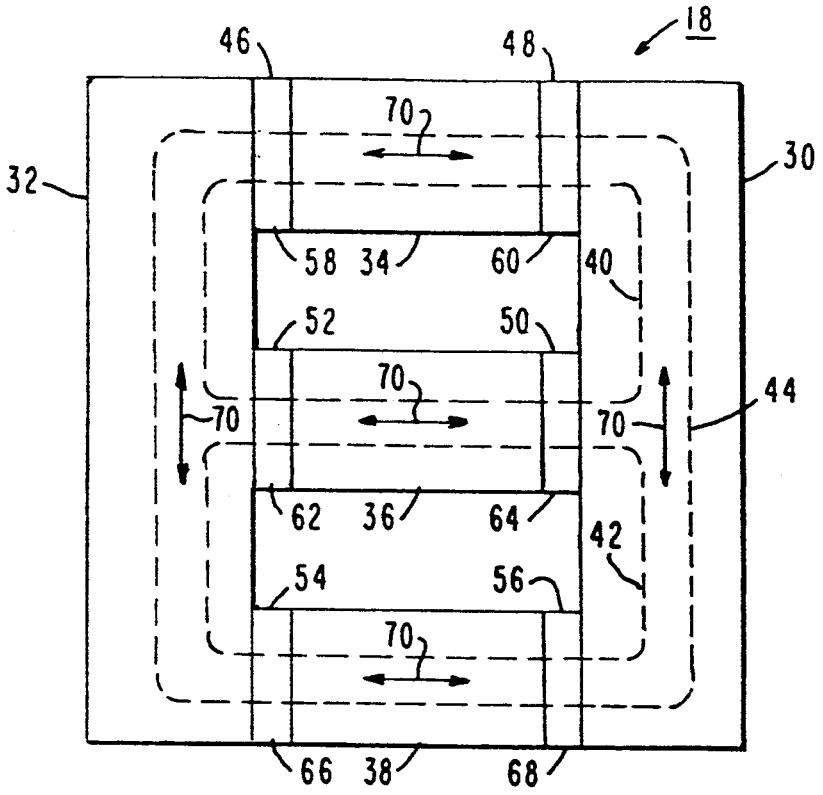
FIG. 3 is a top view of the core of the inductor of FIG. 1.

FIG. 3 is a top view of the magnetic core 18 used in the inductor of FIGS. 1 and 2. This core includes a pair of end pieces 30 and 32. Each including a stack of "I" shaped end piece laminations. Three legs 34, 36 and 38, each including a stack of "I" shaped leg laminations, are positioned between the end pieces to form flux paths 40, 42 and 44. The legs are mounted between the end pieces such that gaps 46, 48, 50, 52, 54 and 56 are formed at locations adjacent to the ends of each of the legs. Nonmagnetic spacers 58, 60, 62, 64, 66 and 68 are positioned within these gaps.

The use of two gaps in each leg of the core, with each gap spanning a distance approximately one half of the width of a single gap found in a prior art inductor reduces flux fringing around the gaps by approximately 33%. In addition, the location of the gaps as shown in FIG. 3 at the ends of the legs instead of near the center, causes coil heating to occur on the end turns of the coils which are easier to cool then the center turns since they have more surface area exposed to the coolant. By using "I" shaped laminations for both the end pieces and the legs, waste material resulting from fabrication of the laminations is reduced.

Grain oriented material such as silicon steel is used to construct the laminations as illustrated in FIG. 3. Arrows 70 show that the grain direction in each of the laminations is substantially parallel to at least one of the core flux paths.

In addition to providing a reduction in heating of the coil turns, the use of two gaps in each leg of the core also achieves inductance balance. This benefit is due to two factors:

(1) The alignment of the grain direction parallel with the flux path in all sections of the core; and (2) The nature of the boundary layer at the junction of the three legs and the end pieces.

Figure 4:
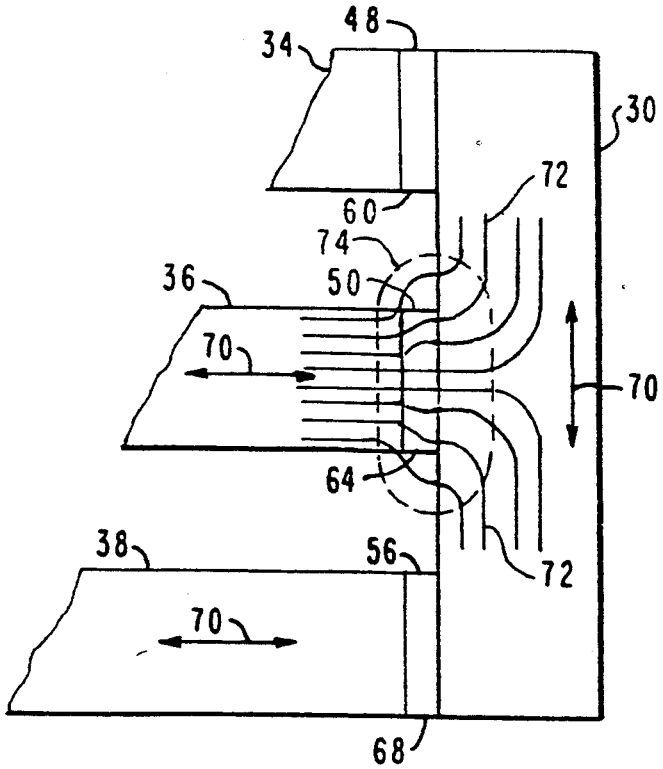
FIG. 4 is a schematic representation of the magnetic flux in a portion of the core of FIG. 3.

FIG. 4 shows a detail of the boundary area where the core legs meet one of the end pieces. The flux lines 72 illustrate a flux distribution in the region of the gap 50. This region may be considered as a boundary area 74. The flux in the end piece 30 is parallel to the grain orientation and the flux leaving the center leg 36 is forced to enter a high reluctance path, the gap 50, exactly as the flux leaving the two outer legs is forced to. This high reluctance point at both ends of each leg provides the benefit of three balanced inductances without requiring removal of some of the laminations of the center leg.

Although the present invention has been described in terms of its preferred embodiment, it will be apparent to those skilled in the art that various changes may be made without departing from the scope of the invention. It is therefore intended that the appended claims cover such changes.

What is claimed is:

1. A multiple phase inductor comprising:

a magnetic core having two end pieces, each of said end pieces including a stack of "I" shaped end piece laminations, and a plurality of legs extending between said end pieces, said magnetic core forming a plurality of flux paths passing through said end pieces and said legs;

a plurality of single layer coils, each of said coils being wound around a corresponding one of said legs;

wherein each of said legs includes a stack of "I" shaped leg laminations positioned between said end pieces to form only two gaps, said gaps being located at opposite ends of each of said legs; and wherein each of said coils includes a plurality of turns of a rectangular cross section, edge wound conductor, said turns being spaced apart form each other.

2. A multiple phase inductor as recited in claim 1, wherein:

said leg laminations and said end piece laminations are grain oriented in a direction parallel to at least one of said flux paths.

3. A multiple phase inductor as recited in claim 1, wherein:

all of said legs have the same cross sectional area.

4. A multiple phase inductor as recited in claim 1, further comprising:

a plurality of non-magnetic spacers, one of said spacers being positioned in each of said gaps.

* * * * *